US010711652B2

(12) United States Patent
Manabe et al.

(10) Patent No.: US 10,711,652 B2
(45) Date of Patent: Jul. 14, 2020

(54) STEAM TURBINE PLANT

(71) Applicant: MITSUBISHI HITACHI POWER SYSTEMS, LTD., Yokohama (JP)

(72) Inventors: Yusuke Manabe, Yokohama (JP); Hitoshi Ishikawa, Yokohama (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 267 days.

(21) Appl. No.: 15/477,134

(22) Filed: Apr. 3, 2017

(65) Prior Publication Data

US 2017/0284228 A1 Oct. 5, 2017

(51) Int. Cl.

| | |
|---|---|
| ***F01K 7/24*** | (2006.01) |
| ***F01K 7/16*** | (2006.01) |
| ***F01D 25/10*** | (2006.01) |
| ***F01K 9/04*** | (2006.01) |
| *F01D 19/00* | (2006.01) |
| *F01K 13/02* | (2006.01) |

(52) U.S. Cl.

CPC ..... *F01K 7/24* (2013.01); *F01D 25/10* (2013.01); *F01K 7/165* (2013.01); *F01K 9/04* (2013.01); *F01D 19/00* (2013.01); *F01K 13/02* (2013.01)

(58) Field of Classification Search

CPC ... F01K 7/24; F01K 7/165; F01K 9/04; F01D 25/10

See application file for complete search history.

(56) References Cited

U.S. PATENT DOCUMENTS 4,561,254 A * 12/1985 Martens ..... F01K 9/04 290/40 C
2011/0167827 A1 7/2011 Leu et al.
2014/0000258 A1* 1/2014 Nishimoto

FOREIGN PATENT DOCUMENTS

| | | | |
|---|---|---|---|
| GB | 2 485 836 A | | 5/2012 |
| JP | 61-213403 A | | 9/1986 |
| JP | 61-167401 U | | 10/1986 |
| JP | 07279614 A | * | 10/1995 |
| JP | 07-109164 B | | 11/1995 |
| JP | 11-210407 A | | 8/1999 |

(Continued)

OTHER PUBLICATIONS

Korean Office Action received in corresponding Korean Application No. 10-2017-0040459 dated Mar. 30, 2018.

(Continued)

*Primary Examiner* — Craig Kim
(74) *Attorney, Agent, or Firm* — Mattingly & Malur, PC

(57) ABSTRACT

Provided are a main steam piping connecting a steam generator and a steam turbine, a bypass piping branched from the main steam piping and bypassing the steam turbine, a bypass valve provided in the bypass piping, a warming piping branched from the bypass valve, a warming valve provided in the warming piping, and a control system. The control system controls the warming valve in such a manner that bypass valve temperature t is brought to within a temperature range satisfying the three conditions: (1) being equal to or higher than the saturated temperature of steam flowing into the bypass valve; (2) having a temperature difference from the flowing-in steam of equal to or less than an allowable value; and (3) being equal to or lower than a temperature at which the formation rate of steam oxidation scale rises.

7 Claims, 2 Drawing Sheets

(56) References Cited

FOREIGN PATENT DOCUMENTS

| | | | |
|---|---|---|---|
| JP | 3117358 | B2 | 12/2000 |
| JP | 2012-97592 | A | 5/2012 |
| JP | 2014-1702 | A | 1/2014 |

OTHER PUBLICATIONS

Extended European Search Report received in corresponding European Application No. 17163673.1 dated Sep. 20, 2017.
Japanese Office Action received in corresponding Japanese Application No. 2016-075891 dated Aug. 20, 2019.

* cited by examiner

STEAM TURBINE PLANT

BACKGROUND OF THE INVENTION

1. Field of the Invention

The present invention relates to a steam turbine plant provided with a turbine bypass valve for bypassing steam from a steam generator before supplying the steam to a steam turbine and with a warming system for the turbine bypass valve.

2. Description of the Related Art

A turbine bypass valve (hereinafter, bypass valve) provided in a turbine bypass piping is usually fully closed when a steam turbine plant is in a normal operating condition (during when a turbine is driven by steam). During this period, steam does not flow through the turbine bypass piping, so that the bypass valve is cooled through radiation of heat. When the bypass valve is opened under this condition, the steam at high temperature flows into the turbine bypass piping, whereby the bypass valve having been cooled is heated rapidly, and a trouble such as thermal shock and thermal deformation may possibly be generated. To cope with this problem, a warming piping for warming up the bypass valve may be arranged. The warming piping is branched from a portion immediately upstream of the bypass valve or from a main body of the bypass valve, and leads steam at a certain flow rate even when the bypass valve is in a fully closed state, thereby warming up the bypass valve; thus, the warming piping plays the role of restraining the above-mentioned trouble due to thermal influences such as thermal shock and thermal deformation (see Japanese Utility Model Laid-open No. Sho 61-167401, Japanese Patent Publication No. Hei 7-109164 and so on).

SUMMARY OF THE INVENTION

In a warming piping of this type, the main purpose is to restrain the thermal influences such as thermal shock and, practically, a large amount of warming steam is let flow in such a manner as to minimize the temperature difference between the bypass valve and the flowing-in steam. However, it has been found by the present inventors that when a bypass valve is exposed to high-temperature steam, steam oxidation scale may possibly be generated on the bypass valve. If the steam oxidation scale is deposited or grown in excess of a limit, an operational trouble of the bypass valve such as valve sticking may possibly be generated. There is a trend in steam turbine plants toward a higher steam temperature for the purpose of enhancing efficiency, so it is important to cope with the steam oxidation scale on the bypass valve.

It is an object of the present invention to provide a steam turbine plant capable of restraining formation of steam oxidation scale on a bypass valve while restraining thermal influences on the bypass valve.

To achieve the above object, a steam turbine plant according to the present invention includes: a steam generator; a steam turbine; a condenser; a main steam piping connecting the steam generator and the steam turbine; a bypass piping branched from the main steam piping and bypassing the steam turbine to be connected to the condenser; a bypass valve provided in the bypass piping; a warming piping branched from a portion of the bypass piping upstream of the bypass valve or from a main body of the bypass valve; a warming valve provided in the warming piping; and a control system that controls the warming valve, wherein the control system is configured to output a signal for controlling the warming valve in such a manner as to control metal temperature of the bypass valve to within a temperature range satisfying following conditions: (1) being equal to or higher than a saturated temperature of steam flowing into the bypass valve; (2) having a temperature difference from the flowing-in steam of equal to or less than an allowable value set according to material of the bypass valve such that a thermal influence produced on the material is equal to or less than a predetermined level; and (3) being equal to or lower than a temperature at which formation rate of steam oxidation scale determined by the material of the bypass valve rises.

According to the present invention, it is possible to restrain the formation of steam oxidation scale on a bypass valve while restraining thermal influences on the bypass valve.

DESCRIPTION OF THE PREFERRED EMBODIMENT

Embodiments of the present invention will be described below, using the drawings.

First Embodiment

1. Steam Turbine Plant

Figure 1:
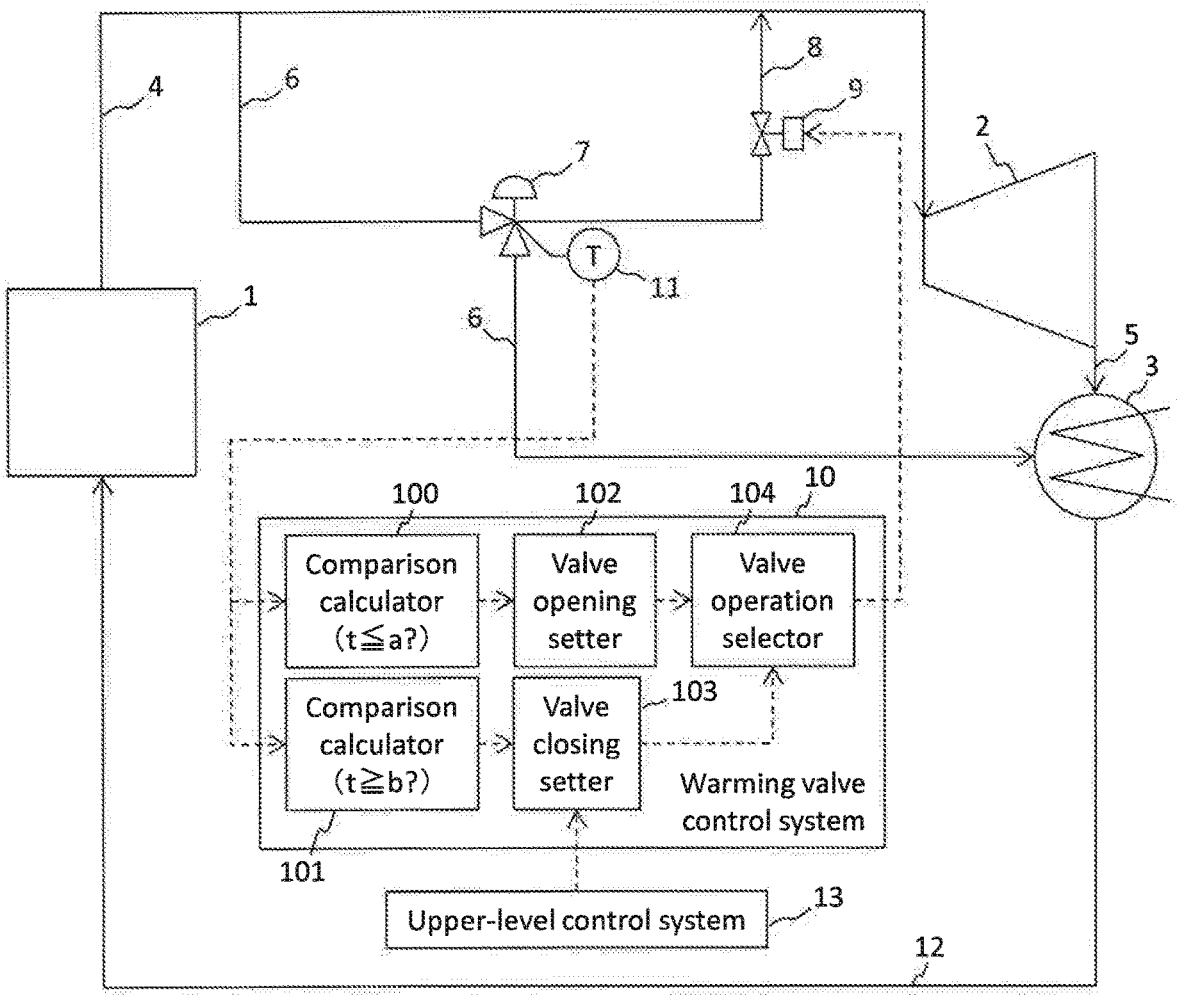
FIG. 1 is a schematic diagram of a steam turbine plant according to a first embodiment of the present invention.

FIG. 1 is a schematic diagram of a steam turbine plant according to a first embodiment of the present invention. The stream turbine plant shown in FIG. 1 includes a steam generator 1, a steam turbine 2, a condenser 3, a main steam piping 4, a turbine exhaust hood 5, a turbine bypass piping 6 (hereinafter, bypass piping 6), a turbine bypass valve 7 (hereinafter, bypass valve 7), a warming piping 8, a warming valve 9, a condensate water piping 12, and a warming valve control system 10 (hereinafter, control system 10).

As the steam generator 1, for example, a fuel-fired boiler can be applied. It is to be noted here that in the case of applying the invention to a nuclear power plant, a reactor can be applied to the steam generator 1, and in the case of applying the invention to a combined cycle power plant, a heat recovery steam boiler using exhaust heat of a gas turbine as a heat source can be applied to the steam generator 1. In addition, while the single steam generator 1 is illustrated, a plurality of stream generators 1 may be included. In regard of the steam turbine 2, while the single turbine is illustrated in FIG. 1, a plurality of turbines such as a high pressure turbine and a low pressure turbine, or a high pressure turbine, an intermediate pressure turbine and a low pressure turbine may be included. The steam turbine 2 is connected to the steam generator 1 through the main steam piping 4. Though not particularly illustrated, a load apparatus (for example, a generator) is linked to the steam turbine 2. The condenser 3 is disposed in such a manner as to receive turbine exhaust steam through the turbine exhaust hood 5, and is connected to the steam generator 1 through the condensate water piping 12.

The bypass piping 6 is branched from the main steam piping 4, bypasses the steam turbine 2, and is connected to the condenser 3. The bypass valve 7 is provided at an intermediate portion of the bypass piping 6. The bypass valve 7 is opened, for example, at the time of start up, load down, or shut down, of the steam turbine plant, to cause steam in the main steam piping 4 to be led to the condenser 3 while bypassing the steam turbine 2 by way of the bypass piping 6, thereby returning the steam to the steam generator 1 without supplying the steam to the steam turbine 2.

The warming piping 8 is branched from a main body of the bypass valve 7 and extends. In this embodiment, the warming piping 8 joins that portion of the main steam piping 4 which is located on the downstream side of the branching portion of the bypass piping 6. The warming valve 9 is provided in an intermediate portion of the warming piping 8. When the warming valve 9 is opened, part of steam flows through the bypass piping 6 and the warming piping 8 even if the bypass valve 7 is in a fully closed state. The quantity of steam passing through the warming piping 8 is determined by a differential pressure in the main steam piping 4 between the branching portion of the bypass piping 6 and the joining portion of the warming piping 8, and a pressure loss in the warming piping 8 (for example, the opening of the warming valve 9). The main body of the bypass valve 7 is provided with a temperature measuring instrument 11 that detects metal temperature of the main body, and a signal detected by the temperature measuring instrument 11 is outputted to the control system 10.

2. Control System

The control system 10 controls the warming valve 9, based on bypass valve temperature t detected by the temperature measuring instrument 11. The control system 10 includes comparison calculators 100 and 101, a valve opening setter 102, a valve closing setter 103, and a valve operation selector 104.

Comparison Calculator

The comparison calculator 100 functions also as an input device for inputting of the bypass valve temperature t outputted from the temperature measuring instrument 11, and includes a storage region in which a determination program and a set temperature a for use in the determination are stored. The comparison calculator 100 performs comparison determination between the bypass valve temperature t and the set temperature a, and outputs a signal to the valve opening setter 102 if $t \leq a$. Similarly, the comparison calculator 101 functions also as an input device for inputting of the bypass valve temperature t, and includes a storage region in which a determination program and a set temperature b (>a) for use in the determination are stored. The comparison calculator 101 performs comparison determination between the bypass valve temperature t and the set temperature b, and outputs a signal to the valve closing setter 103 if $t \geq b$.

Here, the set temperature a is a temperature set for the metal temperature of, for example, the main body of the bypass valve 7 (in this example, the bypass valve temperature t) from the viewpoint of obviating the generation of thermal influences, such as thermal shock or thermal deformation, on the bypass valve 7. Specifically, the set temperature a is a temperature satisfying the following conditions (1) and (2):

(1) being equal to or higher than saturated temperature of flowing-in steam flowing into the bypass valve 7; and (2) having a temperature difference from the flowing-in steam flowing into the bypass valve 7 of equal to or less than an allowable value set according to the material of the bypass valve 7 in such a manner that thermal influence produced on the material is equal to or less than a predetermined level.

The condition (1) is a condition of being within such a range that the flowing-in steam coming into contact with the bypass valve 7 is not turned to be drain, specifically, a condition that the bypass valve temperature t is equal to or higher than the saturated temperature of the flowing-in steam. For instance, in the case where the steam pressure of the flowing-in steam is 20 MPa, the condition (1) is satisfied when the bypass valve temperature t is equal to or higher than 366° C.

The condition (2) is a condition that the difference between the temperature of the flowing-in steam flowing into the bypass valve 7 and the bypass valve temperature t ((the bypass valve temperature t)<(temperature of the flowing-in steam)) is within an allowable value. The allowable value for the temperature difference is a value preliminarily set according to material of the bypass valve 7 and is, for example, a value below which a specific thermal influence such as thermal shock or thermal deformation is not produced (or is limited to within an allowable range if produced) on the material of the bypass valve 7. It has been found by the present inventors that in the case where the material of the bypass valve 7 is chrome steel (a nitrided low-chromium alloy steel, or the like), the thermal influence produced on the material of the bypass valve 7 is restrained when the temperature difference between the bypass valve 7 and the flowing-in steam is equal to or less than 200° C.

In this embodiment, under an assumption that the temperature of main steam flowing through the main steam piping 4 is 600° C., the set temperature a satisfying the conditions (1) and (2) is a value within the range of 400 to 600° C.; when adopting the lower limit from the viewpoint of restraining the generation of steam oxidation scale on the bypass valve 7, the set temperature a can be set at 400° C.

On the other hand, the set temperature b is a temperature set for the metal temperature of, for example, the main body of the bypass valve 7 (in this example, the bypass valve temperature t) from the viewpoint of restraining the generation of steam oxidation scale on the material of the bypass valve 7. Specifically, the set temperature b is a temperature satisfying the following condition (3):

(3) being equal to or lower than a temperature at which formation rate of steam oxidation scale determined by the material of the bypass valve 7 rises.

It has been found by the present inventors that in the case where the material of the bypass valve 7 is, for example, chrome steel (a nitrided low-chromium alloy steel, or the like), the formation rate of steam oxidation scale rises when the bypass valve temperature t exceeds 550° C. Therefore, the condition (3) is satisfied when the bypass valve temperature t is equal to or lower than 550° C. While it is sufficient that the set temperature b is within such a range as to satisfy the condition (3), the set temperature b can be set, for example, at 500° C., taking into account that b>a.

Valve Opening Setter, Valve Closing setter, Valve Operation Selector

The valve opening setter 102 is a functional section which, by receiving a signal inputted from the comparison calculator 100, generates and outputs a command signal for opening the warming valve 9. The valve closing setter 103 is a functional section which, by receiving a signal inputted from the comparison calculator 101, generates and outputs a command signal for closing the warming valve 9. The valve operation selector 104 is an output section by which the command signal outputted from the valve opening setter 102 or the valve closing setter 103 is outputted to the warming valve 9. It is to be noted that during shut-down period of the steam turbine plant, a plant shut-down signal outputted from an upper-level control system 13 for controlling the plant as a whole is inputted to the valve closing setter 103. During when the plant shut-down signal is inputted, the valve closing setter 103 outputs a command signal for closing the warming valve 9, irrespective of the bypass valve temperature t. Hereinafter, the command signal outputted from the valve closing setter 103 in response to the plant shut-down signal may be described as "forced signal" in distinction from other command signals. The forced signal is given priority over the command signal from the valve opening setter 102; even if the command signal from the valve opening setter 102 is being inputted, when the forced signal is being inputted, the valve operation selector 104 selects and outputs the forced signal, to thereby close the warming valve 9.

3. Operation

At the normal operating condition for driving the steam turbine 2, in the steam turbine plant illustrated in FIG. 1, the steam generated in the steam generator 1 flows through the main steam piping 4, to be supplied to the steam turbine 2. When the steam turbine 2 is driven by the steam, the load apparatus is driven by the steam turbine 2. The steam having driven the steam turbine 2 is led through the turbine exhaust hood 5 to the condenser 3, to be water, which is returned through the condensate water piping 12 to the steam generator 1. In the normal operating condition, the bypass valve 7 is kept in a fully closed state, part of the steam flowing through the main steam piping 4 flows into the bypass piping 6 branched from the main steam piping 4, and passes through the bypass valve 7, the warming piping 8 and the warming valve 9 to again merge into the main steam piping 4.

During when the steam turbine plant is in operation, the bypass valve temperature t measured by the temperature measuring instrument 11 is inputted to the control system 10, a signal for opening or closing the warming valve 9 aiming at bringing the bypass valve temperature t into such a temperature range as to satisfy the above-mentioned conditions (1) to (3) is calculated by the control system 10, and the signal is outputted to the warming valve 9. This control of the warming valve 9 by the control system 10 will be described.

When the bypass valve temperature t is inputted from the temperature measuring instrument 11, the control system 10 compares the bypass valve temperature t with the set temperatures a and b by the comparison calculators 100 and 101. In the comparison calculator 100, the bypass valve temperature t is compared with the set temperature a; if the bypass valve temperature t is equal to or lower than the set temperature a, a signal is outputted to the valve opening setter 102, whereas if the bypass valve temperature t is higher than the set temperature a, no signal is outputted. When the signal from the comparison calculator 100 is inputted, the valve opening setter 102 generates a command signal for opening the warming valve 9, and outputs the command signal to the valve operation selector 104. On the other hand, in the comparison calculator 101, the bypass valve temperature t is compared with the set temperature b; if the bypass valve temperature t is equal to or higher than the set temperature b, a signal is outputted to the valve closing setter 103, whereas if the bypass valve temperature t is lower than the set temperature b, no signal is outputted. Since a<b, a situation in which signals are simultaneously outputted from the comparison calculators 100 and 101 during plant operation does not occur. When the signal from the comparison calculator 101 is inputted, the valve closing setter 103 generates a command signal for closing the warming valve 9, and outputs the command signal to the valve operation selector 104. The valve operation selector 104 converts the command signal inputted from the valve opening setter 102 or the valve closing setter 103 into a driving signal for the warming valve 9, and outputs the driving signal to a driving section of the warming valve 9.

As a result of the above control, in the case where the bypass valve temperature t is equal to or lower than the set temperature a, the warming valve 9 is opened, steam flows through the bypass piping 6 and the warming piping 8, the bypass valve 7 is warmed up, and the bypass valve temperature t rises. On the contrary, in the case where the bypass valve temperature t is equal to or higher than the set temperature b, the warming valve 9 is closed, the flow of the steam through the bypass piping 6 and the warming piping 8 is stopped, the bypass valve 7 releases heat, and the bypass valve temperature t falls. As a result, the bypass valve temperature t is maintained between the set temperatures a and b, and the above-mentioned conditions (1) to (3) are satisfied.

It is to be noted here that during when the steam turbine plant is in a shut-down state and it is unnecessary to warm up the bypass valve 7, a plant shut-down signal is inputted from the upper-level control system 13 to the valve closing setter 103 in the control system 10, for example, for a period after a plant shutting-down operation is conducted until a starting-up operation is conducted. During when the plant shut-down signal is being inputted, the valve operation selector 104 outputs the above-mentioned forced signal given by the valve closing setter 103, whereby the warming valve 9 is closed.

4. Effects

By the opening/closing control of the warming valve 9 by the control system 10 as above-described, it is possible to keep the bypass valve temperature t within the temperature range between the set temperature a and the set temperature b, and thereby to effectively restrain formation of steam oxidation scale on the bypass valve 7 while restraining thermal influences, such as thermal shock or thermal deformation, on the bypass valve 7. With the amount of steam oxidation scale formed (the formation rate of steam oxidation scale) being suppressed, it is possible to restrain an operational trouble, such as valve sticking, from occurring due to seizure at a valve sliding portion or a reduction of a gap portion. In addition, there is also a merit that, even in the case where steam used in steam turbine plants is further raised in temperature and pressure in the future, the generation of steam oxidation scale on the bypass valve 7 can be restrained without changing the material of the bypass valve 7 to a special material.

Besides, in general, a configuration is often adopted in which a warming piping is connected to a condenser, and steam lowered in temperature by warming up a bypass valve is led to the condenser by bypassing a steam turbine. In this case, the configuration in which the steam having warmed up the bypass valve is led to the condenser leads to a lowering in plant efficiency. In this embodiment, on the other hand, the steam having warmed up the bypass valve 7 is returned to the main steam piping 4, whereby the plant efficiency can be restrained from being lowered.

Second Embodiment

Figure 2:
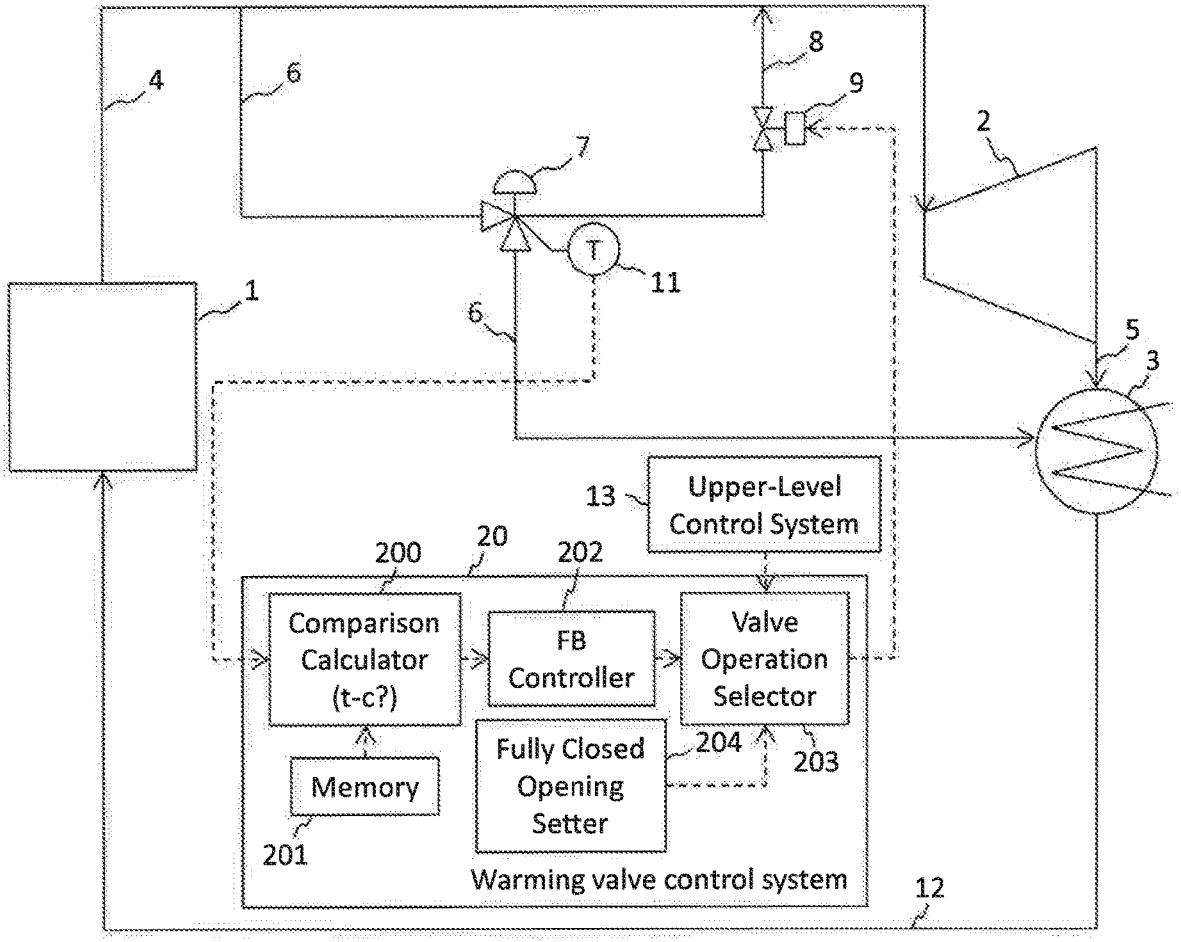
FIG. 2 is a schematic diagram of a steam turbine plant according to a second embodiment of the present invention.

FIG. 2 is a schematic diagram of a steam turbine plant according to a second embodiment of the present invention.

The steam turbine plant according to this embodiment differs from the steam turbine plant according to the first embodiment in that a control system 20 controls the opening of the warming valve 9 in such a manner that the bypass valve temperature t approaches a set temperature c. The other configurations are the same as in the first embodiment, so they are denoted by the same reference symbols in FIG. 2 as those used in FIG. 1, and descriptions of them are omitted. The control system 20 will be described below.

1. Control System

The control system 20 possessed by the steam turbine plant shown in FIG. 2 includes a comparison calculator 200, a memory 201, a feed-back controller (PI controller) 202, a valve operation selector 203 and a fully closed opening setter 204.

Memory

The memory 201 is a storage region in which a determination program to be executed by the comparison calculator 200 and a target temperature c for use in the determination are stored. While the memory 201 is described in distinction from the comparison calculator 200 in this embodiment, a configuration in which the comparison calculator 200 includes the memory 201 may be adopted, like in the first embodiment. On the contrary, a memory in which a program and the set temperatures a and b are stored may be present separately from the comparison calculators 100 and 101 in the first embodiment. The target temperature c is a temperature which is preliminarily selected in a range between the set temperatures a and b ($a<c<b$).

Comparison Calculator

The comparison calculator 200 functions also as an input device for inputting of the bypass valve temperature t outputted from the temperature measuring instrument 11, like the comparison calculators 100 and 101, reads the determination program and the target temperature c from the memory 201, performs comparison determination between the bypass valve temperature t and the target temperature c, calculates a magnitude relation between the bypass valve temperature t and the target temperature c and a temperature difference between the bypass valve temperature t and the target temperature c, and outputs the calculation results to the feed-back controller 202.

Feed-Back Controller

The feed-back controller 202 calculates such an opening command value for the warming valve 9 as to reduce the temperature difference between the bypass valve temperature t and the target temperature c inputted from the comparison calculator 200, and outputs the command value to the valve operation selector 203. The calculation of the command value is executed according to a control program (or a data table) stored in the feed-back controller 202; for example, if the bypass valve temperature t is lower than the target temperature c, a command value such as to enlarge the opening of the warming valve 9 in accordance with the magnitude of the temperature difference is calculated, whereas if the bypass valve temperature t is higher than the target temperature c, a command value such as to reduce the opening of the warming valve 9 in accordance with the magnitude of the temperature difference is calculated.

Fully Closed Opening Setter

The fully closed opening setter 204 is a functional section which outputs to the valve operation selector 203 a full closure signal that is a command signal for fully closing the warming valve 9. During when the steam turbine plant is in operation, the full closure signal is constantly inputted from the fully closed opening setter 204 to the valve operation selector 203.

Valve Operation Selector

The valve operation selector 203 is an output section which outputs to the warming valve 9 the command signal inputted from the feed-back controller 202. It is to be noted here that during when the steam turbine plant is in a shut-down state, a plant shut-down signal is inputted from the upper-level control system 13 to the valve operation selector 203. During when the plant shut-down signal is being inputted, the valve operation selector 203 selects the full closure signal from the fully closed opening setter 204 preferentially over the command signal from the feed-back controller 202, and outputs the full closure signal, to close the warming valve 9.

2. Operation and Effect

During when the steam turbine plant is in operation, the bypass valve temperature t measured by the temperature measuring instrument 11 is inputted to the control system 20, and the opening of the warming valve 9 is controlled by the control system 20 in such a manner that the bypass valve temperature t approaches the target temperature c. Since the target temperature c is a value between the set temperatures a and b, the above-mentioned conditions (1) to (3) are satisfied thereby. It is to be noted here that while a plant shut-down signal is being inputted from the upper-level control system 13 to the valve operation selector 203 in the control system 20, the full closure signal is selected and outputted by the valve operation selector 203 and the warming valve 9 is thereby closed. Accordingly, the same effects as in the first embodiment are obtained.

<Others>

Naturally, the present invention is not limited to the above embodiments, and modifications, additions and deletions of configuration components can be appropriately made within the technical thought of the invention. For instance, while a case where the warming piping 8 is joined to the main steam piping 4 has been taken as an example in the above description, a configuration in which the warming piping 8 is joined to a bypass valve outlet piping (a portion of the bypass piping 6 that is located on the downstream side of the bypass valve 7), the condenser 3, the exterior of the system of the steam turbine plant (inclusive of liberation to the atmospheric air), or other steam equipment lower in pressure than the bypass valve inlet piping (a portion of the bypass piping 6 for connection to an inlet of the bypass valve 7) may also be adopted, from the viewpoint of obtaining the effect of restraining the generation of steam oxidation scale on the bypass valve 7. In addition, while a case where the bypass piping 6 is connected to the condenser 3 has been taken as an example in the above description, a configuration in which the bypass piping 6 is connected to the exterior of the system of the steam turbine plant (inclusive of liberation to the atmospheric air) or other steam equipment lower in pressure than the bypass valve inlet piping (a portion of the bypass piping 6 for connection to an inlet of the bypass valve 7) may also be adopted.

Besides, while a case where the warming piping 8 is branched from the main body of the bypass valve 7 has been taken as an example in the above description, a configuration in which the warming piping 8 is branched from the bypass piping 6 may also be adopted, so long as, for example, the region of branching from the bypass piping 6 is located on the upstream side of the bypass valve 7 and in such a range that the steam temperature is transferred to the bypass valve 7. With such a configuration, also, the bypass valve 7 can be warmed up through transfer of heat from steam, if the steam flows through the warming piping 8.

In addition, while a case where the bypass valve temperature t measured by the temperature measuring instrument 11 is used as a basis for control of the warming valve 9 has been taken as an example in the above description, any state quantity that varies in relation to the bypass valve temperature t can be used in place of the bypass valve temperature t as a basis for control of the warming valve 9. Some examples of such modification will be shown below.

Main Steam Pressure

If a steam pressure is known, the saturated temperature is known. In view of this, a configuration is adopted in which, for example, a pressure measuring instrument is disposed in the main steam piping 4, the steam temperature is estimated on the basis of the steam pressure thus measured by the pressure measuring instrument and, further, a program for determining by what extent the steam temperature will be lowered until the steam flows into the bypass piping 6 and reaches the bypass valve 7, on the basis of the length and diameter of the piping extending from the pressure measuring instrument to the bypass valve 7, etc., is executed by the control system 10, 20. By this, the temperature of the steam flowing into the bypass valve 7 can be estimated based on the pressure of the steam flowing through the main steam piping 4, and the bypass valve temperature t can be measured through calculation based on the estimated steam temperature. Therefore, the warming valve 9 can be controlled, like in the first and second embodiments. The warming valve 9 can be similarly controlled also by use of a data table prepared based on actual measurements conducted preliminarily for measuring by what extent the steam temperature is lowered until the steam flows to the bypass valve 7 from the pressure measuring instrument, on a steam pressure basis.

Steam Temperature

As has been mentioned above, by what extent the steam temperature is lowered until the steam flows into the bypass piping 6 and reaches the bypass valve 7 can be estimated from the piping configuration, etc. Therefore, where a thermometer is disposed in the main steam piping 4 and the bypass valve temperature t is measured through calculation based on the temperature of the steam flowing through the main steam piping 4, the warming valve 9 can thereby be controlled like in the first and second embodiments.

In addition, the temperature of the steam flowing into the bypass valve 7 can be measured through calculation not only from the temperature of the steam flowing through the main steam piping 4, but also from the temperature of the steam flowing through the bypass piping 6, the temperature of the steam in the main body of the bypass valve 7, or the temperature of the steam flowing through the warming piping 8. Therefore, where a thermometer for measuring the internal temperature of the bypass piping 6, the main body of the bypass valve 7, or the warming piping 8 is arranged and the bypass valve temperature t is measured through calculation based on the value thus measured by the thermometer, the warming valve 9 can thereby be controlled like in the first and second embodiments.

Steam Flow

Information on steam flow can contribute to enhancement of accuracy in measurement through calculation of the steam temperature. Therefore, where a flow measuring instrument is disposed in the main steam piping 4, the bypass piping 6 or the warming piping 8 and the value detected by the flow measuring instrument is taken into account, the accuracy in calculation of the bypass valve temperature t can thereby be enhanced.

Gas Turbine Exhaust Temperature

In the case where the steam turbine plant is a combined cycle power plant, the temperature of the steam generated in the steam generator 1 can be estimated based on, for example, exhaust temperature of a gas turbine. Therefore, where a thermometer for measuring the exhaust temperature of the gas turbine is arranged and the bypass valve temperature t is measured through calculation based on the exhaust temperature of the gas turbine, the warming valve 9 can thereby be controlled like in the first and second embodiments.

Plant Load

In the case where a generator is driven by the steam turbine 2, the temperature and pressure of the steam for driving the steam turbine 2 can be estimated from the quantity of electric power generated by the generator. Since the temperature of the steam flowing through the main steam piping 4 can be estimated from the quantity of electric power generated, the bypass valve temperature t can be measured through calculation, so that the warming valve 9 can be controlled like in the first and second embodiments.

Plant Control Signals

Since the steam turbine plant is controlled by the upper-level control system 13, plant status such as the temperature of the steam flowing through the main steam piping 4 can be estimated based on signals outputted from the upper-level control system 13 to the components of the plant. Therefore, the bypass valve temperature t can be measured through calculation based on the plant control signals generated by the upper-level control system 13, and, accordingly, the warming valve 9 can be controlled like in the first and second embodiments.

What is claimed is:

1. A steam turbine plant comprising:

a steam generator;

a steam turbine;

a condenser;

a main steam piping connecting the steam generator and the steam turbine;

a bypass piping branched from the main steam piping and bypassing the steam turbine;

a bypass valve provided in the bypass piping;

a warming piping branched from a portion of the bypass piping upstream of the bypass valve or from a main body of the bypass valve and joining the main steam piping;

a warming valve provided in the warming piping; and a control system that controls the warming valve, wherein the control system is configured to output a signal for controlling the warming valve in such a manner as to control a metal temperature of the bypass valve to within predetermined temperature ranges as follows:

(1) being equal to or higher than a saturated temperature of steam flowing into the bypass valve, the saturated temperature being a saturated temperature of the flowing-in steam at a steam pressure during a normal operating;

(2) having a temperature difference from the flowing-in steam of equal to or less than a first allowable value set in advance as an allowable value for thermal shock or thermal deformation produced on a material of the bypass valve; and (3) being equal to or lower than a second allowable value set in advance based on a relationship between the material of the bypass valve, the metal temperature of the bypass valve, and a formation rate of steam oxidation scale.

2. The steam turbine plant according to claim 1, comprising:

a temperature measuring instrument that measures the metal temperature of the bypass valve by detection or through calculation, wherein the control system generates a signal for opening the warming valve when a value measured by the temperature measuring instrument is equal to or lower than a set temperature a satisfying the temperature ranges (1) and (2), the control system generates a signal for closing the warming valve when the value measured by the temperature measuring instrument is equal to or higher than a set temperature b satisfying the temperature range (3), and the control system outputs the thus generated signal to the warming valve.

3. The steam turbine plant according to claim 2, wherein the material of the bypass valve is chrome steel, the saturated temperature of the flowing-in steam is 366° C., the first allowable value is 200° C., and the second allowable value is 550° C., and wherein the set temperature a is 400° C., and the set temperature b is 500° C.

4. The steam turbine plant according to claim 1, comprising:

a temperature measuring instrument that measures the metal temperature of the bypass valve by detection or through calculation, wherein the control system generates a signal for opening or closing the warming valve in such a manner that a value measured by the temperature measuring instrument approaches a target temperature c that is a value between the set temperature a satisfying the temperature ranges (1) and (2) and the set temperature b satisfying the temperature range (3), and the control system outputs the thus generated signal to the warming valve.

5. The steam turbine plant according to claim 4, wherein the material of the bypass valve is chrome steel, the saturated temperature of the flowing-in steam is 366° C., the first allowable value 200° C., and the second allowable value is 550° C., and wherein the set temperature a is 400° C., and the set temperature b is 500° C.

6. The steam turbine plant according to claim 1, wherein the control system closes the warming valve when a plant shut-down signal is inputted.

7. A steam turbine plant comprising:

a steam generator;

a steam turbine;

a condenser;

a main steam piping connecting the steam generator and the steam turbine;

a bypass piping branched from the main steam piping and bypassing the steam turbine;

a bypass valve provided in the bypass piping;

a warming piping branched from a portion of the bypass piping upstream of the bypass valve or from a main body of the bypass valve and joining the main steam piping;

a warming valve provided in the warming piping; and a control system that controls the warming valve, wherein the control system is configured to output a signal for controlling the warming valve in such a manner as to control a metal temperature of the bypass valve to within predetermined temperature ranges as follows:

(1) being equal to or higher than 366° C. that is a saturated temperature of steam flowing into the bypass valve;

(2) having a temperature difference from the flowing-in steam of equal to or less than 200° C. set in advance as a first allowable value; and (3) being equal to or lower than 550° C. set in advance as a second allowable value.

* * * * *